United States Patent [19]

Okuda

[11] 4,215,680

[45] Aug. 5, 1980

[54] CHAIR FOR HYPNOTHERAPY

[75] Inventor: Iwao Okuda, Okayama, Japan

[73] Assignee: Og Ogiken Co., Ltd., Okayama, Japan

[21] Appl. No.: 897,115

[22] Filed: Apr. 17, 1978

[51] Int. Cl.[2] ..... A61H 1/00; A61H 39/00

[52] U.S. Cl. ..... 128/33; 128/24 R; 128/25 R; 297/61; 297/410

[58] Field of Search ..... 128/33 R, 24 R, 25 R; 297/61, 357, 408, 410; 32/22

[56] References Cited

U.S. PATENT DOCUMENTS

| | | | |
|---|---|---|---|
| 13,396 | 8/1855 | Perkins | 297/408 X |
| 336,387 | 2/1886 | Child | 297/408 X |
| 3,826,250 | 7/1974 | Adams | 128/33 X |

*Primary Examiner*—Henry J. Recla

*Attorney, Agent, or Firm*—Fidelman, Wolffe & Waldron

[57] ABSTRACT

A chair for hypnotherapy of a patient suffering from a mental or physical disorder caused by stress, wherein as the position of the chair and consequently that of the patient seated therein are changed alternately between a first position wherein he is relaxed sitting upright and a second position wherein he is tensioned having the upper half of his body thrown back, he is hypnotized by the help of verbal suggestions and mechanical stimuli simultaneously given and applied to him. While he is in the state of hypnosis, verbal suggestions are given to him so as to remove from his subconsciousness those factors that are causing the disorder.

9 Claims, 8 Drawing Figures

CHAIR FOR HYPNOTHERAPY

This invention relates to a device for hypnotherapy and more particularly to a chair for hypnotizing a patient suffering from a mental or physical disorder caused by stress so as to remove from the patient's mind or subconsciousness those factors which are causing the disorder.

As is well known, hypnosis has been used as a therapeutic method of neurotic disorders without using any medicines or operations. Conventionally hypnotherapy is conducted by a hypnotist who faces a patient and leads him into a state of hypnosis by means of verbal suggestions. Sometimes electrical, optical and/or sonic stimuli are given to the patient to help hypnotize him. Such conventional methods, however, are likely to cause the patient who is to undergo the treatment to feel uneasy so that it takes quite a long time to put the patient into a state of hypnosis. Moreover, whether the patient is hypnotized quickly to a degree required for the purpose depends upon the skill and/or physical and mental conditions of the hypnotist.

Accordingly, it is one object of the invention to provide a chair for hypnotherapy which can effectively put a patient suffering from a physical or mental disorder caused by stress into a state of hypnosis so as to remove from his subconsciousness those factors which are causing the disorder.

In one preferred embodiment of the invention the chair comprises a base; a seat mounted thereon so as to be able to change its angular position relative to the base; a back mounted on the seat so as to be able to change its vertical position or height relative to the seat and comprising an upper and a lower section, the upper section being able to change its angular position relative to the lower section; and a headrest mounted on the upper section of the chair back so as to be able to change its height and angular position relative to the upper section of the chair back.

A patient to undergo hypnotherapy is seated in the chair and as the angular position and/or height of the component parts of the chair are changed manually or automatically in accordance with a predetermined program, the patient seated therein alternately takes a first position in which he is relaxed sitting substantially upright and a second position in which he is tensioned on the rearwardly inclined chair with the upper half of his body thrown back and his nape supported by the rearwardly inclined headrest.

As the position of the patient's body is changed, verbal suggestions and, if necessary, other effective sounds such as music or twittering of birds previously recorded in a magnetic tape are given to him through a speaker annexed to the headrest, and at the same time a vibrator provided inside the headrest gives mechanical stimuli to the patient's neck and a plurality of excitors provided in the chair back repeatedly pat the patient on the back and/or waist, thereby to help increase the hypnotic effect on the patient. When the patient has been put into a state of hypnosis, the speaker continues to give verbal suggestions and other effective sounds to the patient to relieve him of the stress and other factors that are causing the disorder in his mind and/or body.

The invention will be explained in further detail with reference to the accompanying drawings, wherein.

Figure 1:
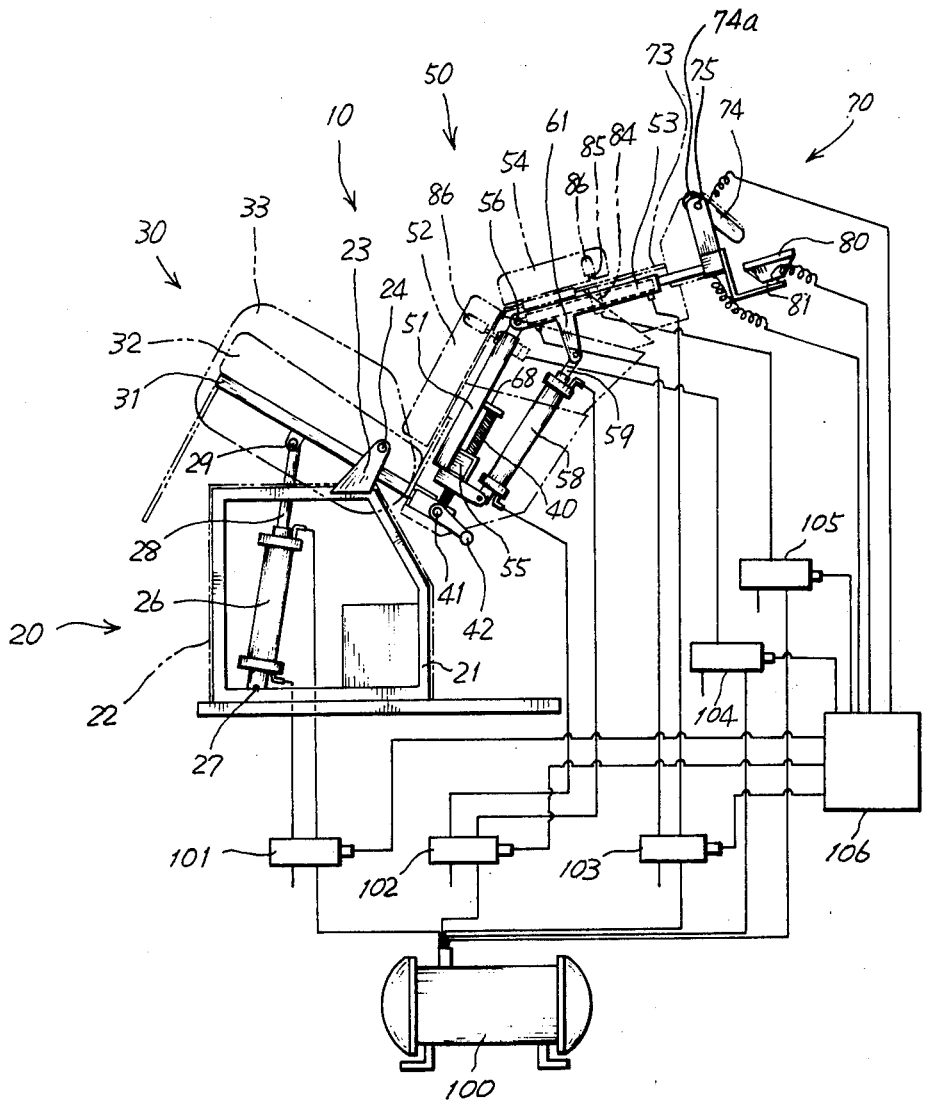
FIG. 1 is a side view of the chair constructed in accordance with the invention, with a schematic diagram of a control system of the component parts of the chair.
Figure 2:
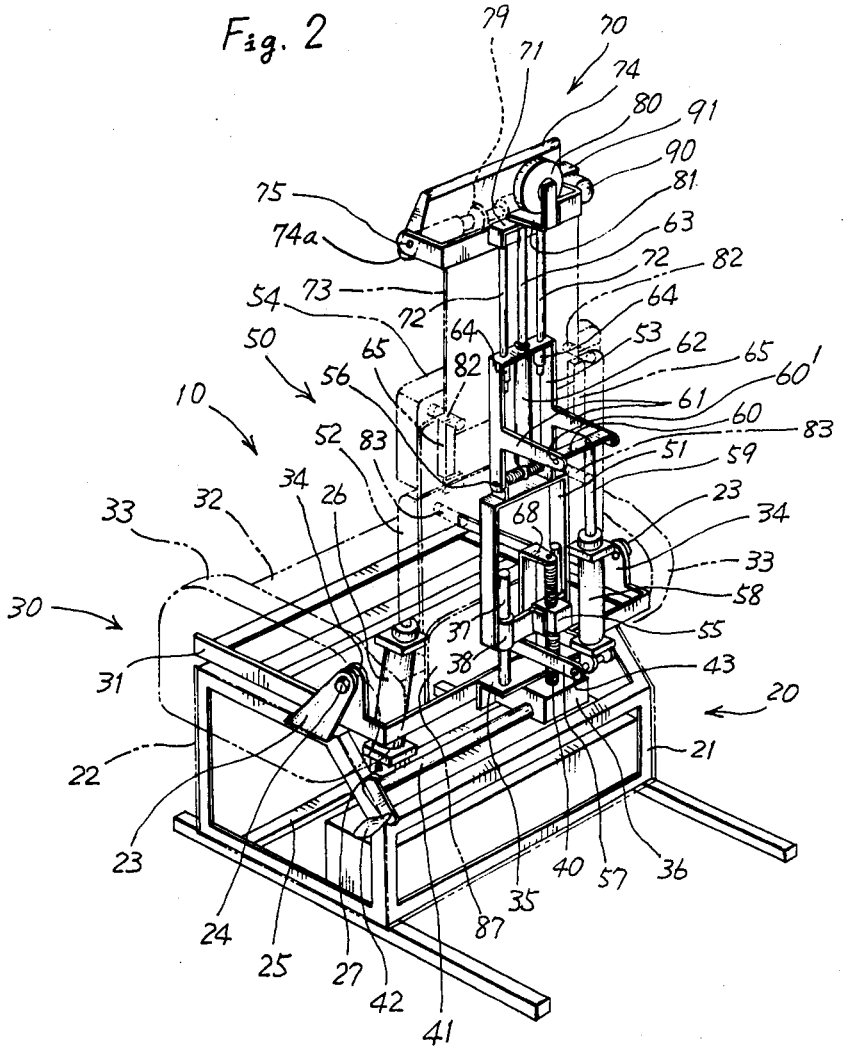
FIG. 2 is a perspective rear view of the chair.

Referring now in detail to the drawings, there is shown a chair generally designated at 10, which comprises a base 20, a seat 30 mounted thereon, a back 50 connected to the seat and a headrest 70 attached to the top of the chair back. The base 20 comprises a frame 21 and a case 22 covering the frame. The seat 30 comprises a frame 31 and a cushion 32 secured thereto in a suitable known manner. The seat cushion 32 is provided with a pair of armrests 33 at the opposite lateral sides thereof.

The back 50 comprises an upper and a lower section. The lower section comprises a lower frame 51 and a lower cushion 52 secured thereto in a suitable known manner, while the upper section comprises an upper frame 53 and an upper cushion 54 secured thereto in a suitable manner.

The headrest 70 is supported by the upper frame 53 of the chair back so that the headrest is raised or lowered relative to the frame 53 by a mechanism to be described later in detail.

The base frame 21 is provided with a pair of upstanding brackets 23 and the seat frame 31 is provided with a corresponding pair of tongues 34, which are connected to the brackets 23 by a pivot pin 24.

The base frame 21 includes a cross bar 25, to which a double-acting pneumatic cylinder 26 has its lower end pivoted by a pin 27. The cylinder 26 has a piston rod 28, the upper end of which is pivoted to the seat frame 31 at 29. As can be easily seen, as the cylinder 26 is operated to project or withdraw the piston rod 28, the seat frame 31 and consequently the seat 30 changes its angular position relative to the base 20.

The seat frame 31 is provided on the rear side thereof with a bracket 35 and a gear box 36. A pair of upright guide rods 37 stand fixed on the bracket 35 and extend slidably through a pair of tubular blocks 38 fixed to the lower back frame 51. A screw rod 40 projects upwardly from the gear box 36 so as to engage with a nut 55 secured to the lower seat frame 51. The upper end of the screw rod 40 is rotatably supported by a bracket 68 secured to the lower back frame 51.

Within the gear box 36 a bevel gear not shown is fixed to the lower end of the screw rod 40 and meshes with a corresponding bevel gear not shown but fixed to a horizontal shaft 41 within the gear box, from which the shaft 41 extends and is provided with a handle 42 at the outer end thereof. As can be easily seen, as the handle 42 is turned, the screw rod 40 is rotated so that the lower back frame 51 with the upper back frame 53 thereon and consequently the chair back as a whole is raised or lowered through the nut 55 engaged by the screw rod 40, with the tubular blocks 38 on the lower back frame 51 sliding along the guide rods 37.

The upper back frame 53 has its lower side pivoted at 56 to the upper side of the lower back frame 51. A pair of horizontal support arms 57 are fixed to and extend rearwardly from the lower back frame 51. A second double-acting pneumatic cylinder 58 has its lower end pivoted by a pin 43 to the support arms 57 and is provided with a piston rod 59, the upper end of which is fixed to a cross bar 60 pivoted at 60' to a pair of horizontal arms 61 extending from the upper back frame 53. As can be easily seen, as the cylinder 58 is operated, the upper back frame 53 changes its angular position relative to the lower back frame 51.

A third pneumatic cylinder 62 is mounted on the upper back frame 53 and provided with a piston rod 63 extending upwardly from the upper side of the upper back frame 53. The headrest 70 comprises a frame 71, to which the upper end of the piston rod 63 is fixed. The upper back frame 53 is provided with a pair of tubular blocks 64, which slidably receive a pair of guide rods 72 the upper ends of which are fixed to the frame 71 of the headrest 70. As can be easily seen, as the cylinder 62 is operated to move the piston rod 63, the headrest 70 is raised or lowered relative to the chair back.

A protector plate 73 has its upper end fixed to the frame 71 of the headrest 70 and extends downwardly behind the cushion 54 of the upper section of the chair back with its opposite lateral edges being engaged by a pair of guide members 65 so that as the headrest is raised or lowered in the manner mentioned just above, the protector plate 73 is moved up or down, while preventing the back or head of a patient seated in the chair from being in contact with the piston rod 63, the guide rods 72 and the other mechanical members behind the chair back or the headrest.

The headrest further comprises a pillow 74 supported by the frame 71 rotatably about a shaft 75 so that the pillow can be inclined rearwardly within a predetermined angular range relative to the frame. The pillow 74 has a nape-supporting portion **74*a* adapted to be in supporting contact with the nape of the patient when the pillow is inclined rearwardly. To incline the pillow rearwardly a motor 90 is attached to the frame 71 of the headrest 70 and has its output shaft not shown connected to the shaft 75 through a suitable reduction gear not shown but enclosed in a gear box 91 also attached to the headrest frame 71. As can be easily seen, as the motor 90 is rotated, the pillow 74 is inclined rearwardly about the shaft 75**.

A vibrator 79 is enclosed in the pillow. A speaker 80 is supported by a bracket 81 fixed to the headrest frame 71.

A pair of excitors 82 are provided in the upper section of the chair back. The two excitors are spaced laterally apart from each other so that they contact two predetermined laterally spaced points below the shoulders on the back of a person seated in the chair.

Another pair of excitors 83 are provided in the lower section of the chair back. The two excitors are spaced laterally apart from each other so that they contact two predetermined laterally spaced points on the waist of the patient.

Figure 3:
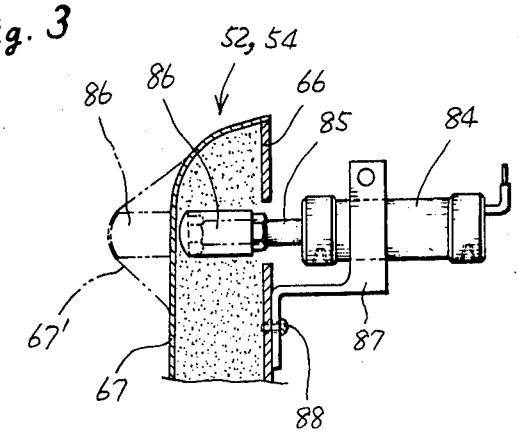
FIG. 3 is an enlarged side sectional view of a patting device provided on the chair back.

Since the four excitors 82 and 83 are of the same construction, only one of them will be explained below with reference to FIG. 3. The excitor comprises an actuator such as a pneumatic cylinder 84 adapted to axially reciprocate an output rod 85 having a head 86 at the forward end thereof. A bracket 87 has its one end fixed as at 88 to the rear plate 66 of the cushion 52 or 54 of the chair back and its other end adapted to support the actuator 84 so that the rod 85 extends into the cushion for the head 86 thereof to be positioned near the inner surface of the covering material 67 such as cloth or leather of the cushion. As the rod 85 is axially reciprocated by the cylinder 84, the flexbility and resiliency of the material 67 allows the head 86 to repeatedly form a projection or convex portion 67' on the surface of the cushion 52 or 54 of the chair back thereby repeatedly pushing or patting the back and/or waist of the patient leaning against the chair back.

A source 100 such as an air compressor supplies pneumatic fluid to the cylinders 26, 58, 62 and 84 through valves 101 to 105 of, say, an electromagnetic type inserted in the conduits connecting the cylinders and the source. A controller 106 controls the valves 101 to 105, the vibrator 79, the speaker 80 and the motor 90 in the manner to be described later in detail.

The source 100, the controller 106 and the tubular and electrical connections are shown in FIG. 1 outside the chair for simplicity and clarity of illustration. They can be enclosed in, e.g., the case of chair base, with a control panel arranged outside for easy manual operation of the switches, etc. provided thereon. Preferably, the compressor 100 is installed away from the chair so as to prevent the running noise of the compressor from interfering with the hypnotic effect on the patient.

FIGS. 4A to 4E schematically shows the different operating positions of the chair when it is used for hypnotizing a patient for therapeutic purpose.

Figures 4A, 4B, 4C:
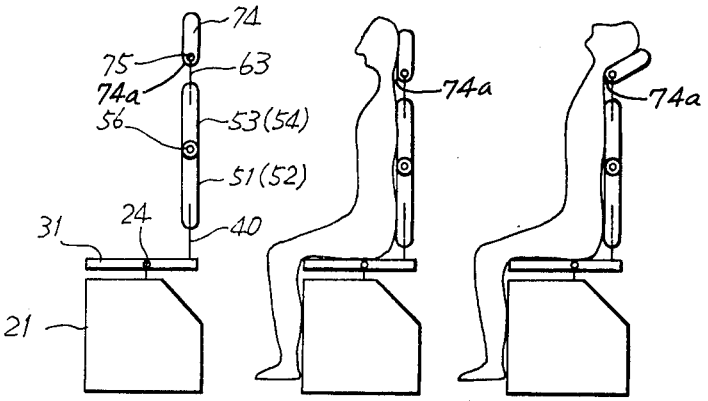
FIGS. 4A to 4E schematically show the chair and the patient seated therein in different operating positions.

FIG. 4A shows the chair ready for a patient to be seated therein. A patient to be hypnotized is seated in the chair so that he is supported by both the upper and lower cushions 52 and 54 of the chair back. At the same time the handle 42 is turned to rotate the screw rod 40 so as to adjust the height of the chair back in accordance with the height of the patient seated in the chair so that the pillow 74 is positioned behind the patient's head (FIG. 4B). The pillow is then inclined rearwardly so that the face of the patient is turned upward (FIG. 4C).

Figures 4D, 4E:
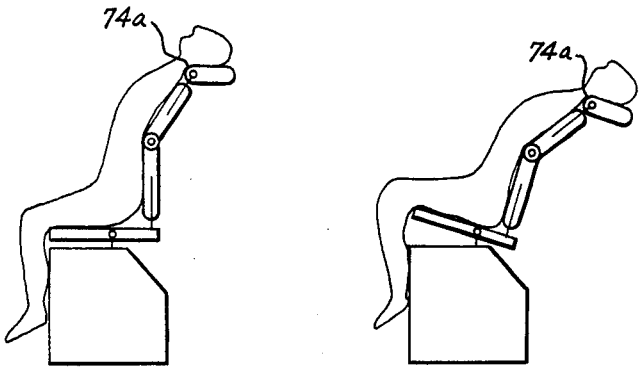

The cylinder 58 is then operated to withdraw the rod 59 so that the upper section of the chair back is abruptly inclined rearwardly, whereupon the patient leaning thereagainst has the upper half of his body thrown back. At the same time the cylinder 62 is so operated as to lower the headrest 70 thereby to hold the patient's head in place on the pillow 74 with his nape in contact with the nape-supporting portion of the pillow as the upper chair back section is inclined rearwardly (FIG. 4D). Then the cylinder 26 is operated so that the piston rod 28 projects upwardly thereby to incline the chair seat and consequently the chair back and the headrest rearwardly, with the patient seated therein falling on his back (FIG. 4E).

Finally, from the inclined position of FIG. 4E the chair is abruptly restored to the upright position of FIG. 4B, whereupon one cycle of operation is completed, which is followed by another cycle. As many cycles as are desired may be repeated.

In the course of operation the speaker 80 is operated to give the patient in the chair verbal suggestions and if necessary, some effective sounds such as music or twittering of birds in accordance with the different positions shown in FIGS. 4B to 4E and at the same time, especially in the steps of FIGS. 4C, 4D and 4E, the vibrator 79 and/or the excitors 82 and/or 83 are operated to give mechanical stimuli to the nape and/or the back and/or the waist of the patient to increase the hypnotic effect on him.

The operation is controlled by the controller 106 which may operate in accordance with a predetermined program recorded in, say, a magnetic tape, in which the verbal suggestions and effective sounds may also be recorded.

Experience shows that it is possible to effectively hypnotize a person by repeatedly subjecting his mind alternately to tension and relaxation. A patient seated in the chair of the invention is relaxed when the chair takes the position shown in FIG. 4B and he is tensioned when the chair takes the position shown in FIGS. 4C, 4D and 4E. In the position of FIG. 4C, the patient is seated in the chair with his face turned upward and his nape in contact with the nape-supporting portion 74*a* of the pillow 74. This puts the patient into a state of tension, which is multiplied by the tension caused by subsequent rearward inclination of the chair back. The position of FIG. 4C is changed to the position of FIG. 4D and then to that of FIG. 4E, with the nape of the patient being supported by the nape-supporting portion 74*a* of the pillow while the positions of FIGS. 4C, 4D and 4E are being taken. While the position of the patient changes from FIG. 4C to 4D and then to FIG. 4E, the patient is kept tensioned, with the nape-supporting portion always in contact with the patient's nape together with the positional change contributing to the tensioned state. Then the position of FIG. 4E is abruptly restored to the upright position of FIG. 4B, thereby putting the patient back into relaxation.

The positional change from FIG. 4B through 4E may be effected sequentially in a short period of time or preferably substantially simultaneously. The verbal suggestions and effective sounds given through the speaker in the course of operation lead the patient into a state of hypnosis, with the stimuli simultaneously applied by the vibrator and/or the excitors to the patient in the positions of FIGS. 4C to 4E contributing to the hypnotic effect. When the patient has fallen into a state of hypnosis, the verbal suggestions given through the speaker help gradually dissipate or remove from the patient's subconsciousness the various factors that are causing the disorder in his mind or body.

When the required treatment has been finished, the patient is restored to the normal state by a verbal language which induces awareness.

A preferred embodiment of the invention having been described, there are various changes and modifications thereof. For example, the pneumatic cylinders may be replaced by hydraulic cylinders or a mechanical linkage driven by an electric motor through a suitable gearing.

It has now become apparent that the device of the invention is able to automatically perform hypnotic treatment or hypnotherapy on a patient suffering from a mental or physical disorder such as neurosis caused by stress as effectively as if a skilled hypnotist were personally performing the treatment and that since the device of the invention does not rely solely on electrical, sonic, or optical stimuli but uses not only verbal suggestions and effective sounds but also physical stimuli, the patient feels quite easy and can be hypnotized naturally. Handling of the chair requires no particular skill or expert knowledge but a usual doctor can use the chair for hypnotherapy more effectively than an expert hypnotist.

What I claim is:

1. A chair for hypnotherapy comprising:
a base having front and back portions;
a seat mounted to said base and rotatable to frontward and backward positions relative to said base;
a back having a lower section mounted to said seat for vertical adjustment relative to said seat;
an upper section mounted to said lower section for forward and backward rotation relative to said lower section;
a head rest mounted to said upper section for vertical adjustment relative to said upper section and for forward and rearward rotation relative to said upper section; and
a control means to provide rearward rotation of said head rest relative to said upper section, rearward rotation of said upper section relative to said lower section, rearward rotation of said seat relative to said base, and abrupt forward restoration of the rearwardly rotated parts of said chair to an upright position; whereby a patient seated in said chair is subjected to tensioned positions during rearward rotation of said parts of said chair and to a relaxed position upon abrupt restoration of said chair to an upright position.

2. The chair of claim 1, further including means for providing sounds effective for hypnosis so as to be heard by a person seated in said chair.

3. The chair of claim 2, further including means for repeatedly giving mechanical stimuli to the nape of a person seated in said chair.

4. The chair of claim 3, further including means for repeatedly giving mechanical stimuli to the back and/or waist of a person seated in said chair.

5. The chair of claim 2, further including means for repeatedly giving mechanical stimuli to the back and/or waist of a person seated in said chair.

6. The chair of claim 2, wherein said sounds include verbal suggestions.

7. The chair of claim 1, further including means for repeatedly giving mechanical stimuli to the nape of a person seated in said chair.

8. The chair of claim 7, further including means for repeatedly giving mechanical stimuli to the back and/or waist of a person seated in said chair.

9. The chair of claim 1, further including means for repeatedly giving mechanical stimuli to the back and/or waist of a person seated in said chair.

* * * * *